US007582400B2

(12) United States Patent
Nakayama et al.

(10) Patent No.: US 7,582,400 B2
(45) **Date of Patent: *Sep. 1, 2009**

(54) MAGNETIC TONER AND IMAGE FORMING METHOD USING THE SAME

(75) Inventors: Yukinori Nakayama, Osaka (JP); Kouzou Teramoto, Osaka (JP); Hiroshi Mizuhata, Wakayama (JP); Kousuke Satou, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 440 days.

This patent is subject to a terminal disclaimer.

(21) Appl. No.: 11/245,489

(22) Filed: Oct. 7, 2005

(65) Prior Publication Data

US 2006/0078813 A1 Apr. 13, 2006

(30) Foreign Application Priority Data

Oct. 8, 2004 (JP) ..... 2004-296902

(51) Int. Cl.
*G03G 9/083* (2006.01)

(52) U.S. Cl. ..... 430/106.2; 430/106.1

(58) Field of Classification Search ..... 430/106.1, 430/106.2

See application file for complete search history.

(56) References Cited

U.S. PATENT DOCUMENTS 5,843,610 A 12/1998 Uchida et al.
5,874,019 A 2/1999 Uchida et al.
6,653,036 B1 11/2003 Tanikawa et al.
7,410,740 B2 * 8/2008 Nakayama et al. ..... 430/108.1
2002/0076635 A1 6/2002 Yoshino et al.

FOREIGN PATENT DOCUMENTS

| | | |
|---|---|---|
| CN | 1355450 | 6/2002 |
| JP | 9-59024 | 3/1997 |
| JP | 11-153882 | 6/1999 |
| JP | 2000-162817 | 6/2000 |
| JP | 2000-242029 | 9/2000 |

OTHER PUBLICATIONS

Diamond, A.S., ed, Handbook of Imaging Materials, Marcel Dekker, Inc., NY (1991), pp. 165-168.*

* cited by examiner

*Primary Examiner*—Janis L Dote
(74) *Attorney, Agent, or Firm*—Smith, Gambrell & Russell, LLP

(57) ABSTRACT

Magnetic toner involves magnetic powder 1 having the particle shape of an octahedron 2 that is a convex polyhedron surrounded by eight triangles as a basis, each of the vertexes and edges of the octahedron being in a curved surface shape, and having a portion 3 that can be taken as a straight line on the outer periphery of its projected image. Therefore, the magnetic toner is superior in both two contradictory properties, that is the property of making it easy for a charging amount to quickly rise as well as improving the charging amount and the property of making it difficult for charge-up to occur, thereby making it possible to form a good image under a wide environment. In an image forming method, an electrostatic latent image is developed into a toner image by a magnetic one-component jumping developing method using the magnetic toner.

3 Claims, 3 Drawing Sheets

MAGNETIC TONER AND IMAGE FORMING METHOD USING THE SAME

BACKGROUND OF THE INVENTION

The present invention relates to a magnetic toner and an image forming method using the same.

In image forming apparatuses such as laser printers, electrostatic copying machines, plain paper facsimiles, and their complex machines utilizing electro photographic methods, electrostatic recording methods, or electrostatic printing methods, a surface of a latent image holding member is uniformly charged by charging means, and is then exposed by exposure means such as semiconductor lasers or light-emitting diodes, to form an electrostatic latent image on the surface, and the electrostatic latent image is then developed into a toner image by developing means. The toner image is then directly transferred to a surface of a material to be printed such as paper by transfer means or is transferred to a surface of an intermediate transfer member, is then transferred again on the surface of the material to be printed such as paper, and is then fixed to the surface by fixing means, to complete a series of image forming steps.

Developing methods for developing an electrostatic latent image into a toner image are roughly divided into dry developing methods and wet developing methods. Currently, the dry developing methods have spread widely. The dry developing methods are classified into developing methods using magnetic toner having magnetic powder involved in its toner particles composed of binder resin (a magnetic one-component developing method, a magnetic two-components developing method, etc.) and developing methods using non-magnetic toner having no magnetic powder involved therein (a non-magnetic one-component developing method, a non-magnetic two-components developing method, etc.) when they are classified on the basis of the type of toner to be used.

In the magnetic one-component developing methods, the magnetic toner is supplied while forming a thin layer of the magnetic toner on a surface of a developer carrying member incorporating a fixed magnet, and the electrostatic latent image on the latent image holding member is then developed into the toner image by the thin layer of the magnetic toner. Examples of the magnetic one-component developing methods include developing methods using magnetic toner having conductive properties and developing methods called magnetic one-component jumping developing methods using magnetic toner having insulating properties. Currently, the latter magnetic one-component jumping developing methods have spread widely.

In the magnetic one-component jumping developing method, the magnetic toner is first supplied to a surface of the developer carrying member while being subjected to triboelectric charging by being passed through a clearance between the developer carrying member that is rotated and that is contained a fixed magnet therein and a magnetic blade disposed in close proximity to the developer carrying member, and is held by a magnetic force of the contained fixed magnet, to form a thin layer of the magnetic toner on the surface of the developer carrying member.

A direct current bias voltage or a bias voltage obtained by overlapping an alternating current with a direct current is applied between the latent image holding member for holding the electrostatic latent image and the developer carrying member that are opposed to each other with a clearance held there between so as not to come into contact with the formed thin layer, thereby scattering the charged magnetic toner on the surface of the latent image holding member from the thin layer, to develop the electrostatic latent image into a toner image.

In the magnetic one-component jumping developing method, the magnetic toner having insulating properties is used, so that transfer of the formed toner image on a surface of a material to be printed such as paper utilizing an electric field, which has been impossible in a case where toner having conductive properties is used, becomes possible. Further, the latent image holding member can be also prevented from being destroyed by electric leakage.

Further, the magnetic toner having insulating properties also has the following advantages:

the magnetic toner is easily charged, the magnetic toner can be sufficiently rubbed against the developer carrying member in a state where magnetic toner is held by the magnetic force, and the electrostatic latent image can be developed in a non-contact state with the electrostatic latent image while holding the magnetic toner by the magnetic force.

Therefore, an image superior in quality can be formed by preventing such fogging that toner adheres to a non-printed portion and a blank portion of the formed image.

In recent years, in an image forming apparatus, such two currents, that is, increase in image formation speed and miniaturization have been rapidly progressing. In a high-speed machine mainly adaptable to business applications where the increase in image formation speed is required, the resolution and the quality of a formed image are liable to decrease as the printing speed increases. In order to prevent that, it is required that the charging amount of the magnetic toner easily rises more quickly than ever before and is more stable than ever before.

On the other hand, in an intermediate- and low-speed machine designed for small offices and general homes where miniaturization is required, the turn-on and turn-off of power are frequently repeated. In order to make warming-up time after turning on power as short as possible, therefore, initial charging of the magnetic toner must be good. For the image forming apparatus, further increase in resolution and quality of the formed image, improvement in durability of the magnetic toner, improvement in stability to environmental variations, and so forth have been continuously required irrespective of the difference in the image formation speed depending on applications, for example.

In order to satisfy the requirements to stably maintain good image properties (high image density, no fogging, and superior image quality) under various temperature and humidity environments over a long time period, the following are required for the magnetic toner:

a charging amount easily rises quickly, and a proper charging amount can be always maintained without causing deficiency in charging amount and charge-up (excessive charging) under such environments that charging is difficult, for example, high-temperature and high-humidity environments and conversely, such environments that charging is excessive, for example, low-temperature and low-humidity environments, and the proper charging amount can be maintained over a long time period.

Currently in the magnetic toner generally employed, however, the requirements have not been sufficiently satisfied in the present circumstances in the above-mentioned currents, that is, increase in image formation speed and miniaturization. The main cause is magnetic powder involved in the magnetic toner according to inventor's examination.

Generally used as the magnetic powder are currently magnetic powder in the shape of a polyhedron such as a hexahedron (a cube, a rectangular parallelepiped) that is a convex polyhedron surrounded by six quadrilaterals and an octahedron that is a convex polyhedron surrounded by eight triangles and magnetic powder in the shape of a sphere.

In the magnetic toner using the polyhedral magnetic powder, however, pointed vertexes or pointed edges between adjacent faces of the magnetic powder are exposed to surfaces of toner particles and charges are easily discharged there from, so that the charges are liable to leak. The polyhedral magnetic powder is low in fluidity and is inferior in dispersibility to binder resin. Accordingly, it is difficult to uniformly disperse the magnetic powder in the binder resin. Therefore, there easily occur variations in the dispersed state and the content of the magnetic powder among the toner particles, so that the magnetic toner also easily varies in the ease of charging, the charging amount, and so on.

In the magnetic toner using the polyhedral magnetic powder, therefore, the charging amount does not easily rise quickly, and the charging amount itself is small. As a result, image defects such as decrease in image density and occurrence of fogging are liable to occur. Further, the magnetic toner easily varies in the ease of charging and the charging amount depending on the temperature and humidity environments at the time of image formation. Particularly under environments, where charging is difficult, such as high-temperature and high-humidity environments, the above-mentioned image defects are liable to further occur.

On the other hand, the spherical magnetic powder has no pointed vertexes and edges. In the magnetic toner using the spherical magnetic powder, therefore, charges are not easily discharged from the magnetic powder exposed to the surfaces of the toner particles, so that the charges do not easily leak. The spherical magnetic powder is superior in fluidity and is also superior in dispersibility to the binder resin compared with the polyhedral magnetic powder. Accordingly, the magnetic powder is easy to uniformly disperse in the binder resin. Therefore, the magnetic powder can be made uniform in the ease of charging, the charging amount, and so on by preventing variations in the dispersed state of the magnetic powder from occurring among the toner particles.

In the magnetic toner using the spherical magnetic powder, however, charges are conversely too easily stored. Therefore, there occurs so-called charge-up in which the magnetic toner is charged in excess of not less than a predetermined charging amount in cases such as a case where the magnetic toner is repeatedly rubbed in a clearance between the developer carrying member and the magnetic blade. When the charge-up occurs, image defects represented by decrease in image density rather easily occurs.

In order to make use of both the respective advantages of the spherical magnetic powder and the polyhedral magnetic powder, therefore, magnetic powders having various particle shapes have been examined.

The following documents, for example, disclose magnetic powders each having the particle shape of a polyhedron such as a hexahedron or an octahedron, whose vertexes and edges are each subjected to so-called chamfering at a plane smaller than each of faces constituting the polyhedron.

- Japanese Unexamined Patent Publication No. JP11-153882A (1999)
- Japanese Unexamined Patent Publication No. JP2000-162817A
- Japanese Unexamined Patent Publication No. JP2000-242029A In the magnetic powders disclosed in the documents, however, pointed edges still exists between the face composing the polyhedron and the small plane used for the chamfering. Charges are easily discharged from the edges. Accordingly, the charges are liable to leak from the magnetic toner, so that image defects such as decrease in image density and occurrence of fogging may occur.

SUMMARY OF THE INVENTION

An object of the present invention is to provide magnetic toner superior in both two contradictory properties, that is, the property of making it easy for a charging amount to quickly rise as well as to be improved and the property of making it difficult for charge-up to occur and allowing a good image to be always formed under a wide environment and an image forming method using the same.

In order to solve the above-mentioned problems, the inventors have examined the use of magnetic powder having the particle shape of an octahedron that is a convex polyhedron surrounded by eight triangles as a basis, each of the vertexes and edges of the octahedron being in a curved surface shape.

The magnetic powder having the above-mentioned particle shape has vertexes and edges in a curved surface shape and does not have pointed vertexes and edges from which charges are easily discharged. Therefore, the magnetic powder can make it more difficult for charges to leak in a case where it is involved in magnetic toner, as compared with the magnetic powders each having the shape of a polyhedron, whose vertexes and edges are each chamfered at a small plane, as disclosed in the documents.

The magnetic powder is superior in fluidity and dispersibility to binder resin because any of the vertexes and edges of the polyhedron is in a curved shape, as described above. Accordingly, the magnetic powder is easy to uniformly disperse in the binder resin. Therefore, the magnetic powder can be made uniform in the ease of charging, the charging amount, and so on by preventing variations in the dispersed state of the magnetic power from occurring among toner particles.

Moreover, the basic shape of the magnetic powder is an octahedron. Accordingly, the adjacent faces with any one of the vertexes or the edges interposed there between or the adjacent edges with any one of the vertexes interposed there between both constitute the octahedron always cross at acute angles of less than 90 degrees. Although both of the vertexes at which the faces or the edges cross at acute angles and the edges at which the faces cross at acute angles are each in a curved surface shape, charges are easily concentrated. Therefore, the charges can be discharged at a proper rate from the vertexes or edges, thereby making it difficult to cause charge-up to occur in a case where the magnetic powder is involved in the magnetic toner.

Even if the particle shape is the above-mentioned octahedron, however, the effect of preventing the charge-up of the magnetic toner by discharging charges at a proper rate from the vertexes or edges in a curved surface shape is not obtained when the respective radii of curvature of the vertexes and edges are too large. Therefore, the inventors have considered that the respective ranges of the radii of curvature of the vertexes and edges in a curved surface shape are defined from a projected image of magnetic powder picked up using a transmission electron microscope (TEM) or the like.

As a result, the inventors have found out that magnetic powder having the shape of an octahedron, whose vertexes and edges are each in a curved surface shape, and having a portion that can be taken as a straight line on the outer periphery of its projected image allows charges to be discharged at a proper rate from the vertexes or edges at which charges are easily concentrated and allows charge-up of magnetic toner to be prevented while making it more difficult for the charges to leak, as compared with magnetic power, whose vertexes and edges are not each in a curved surface shape.

That is, magnetic powder having a shape close to a spherical shape not having a portion that can be taken as a straight line on the outer periphery of its projected image because the vertexes and edges in a curved surface shape have too large radii of curvature so that adjacent curved faces connect with each other cannot give the effect of preventing the charge-up of the magnetic toner, similarly to spherical magnetic powder.

On the other hand, in magnetic powder having the shape of an octahedron, whose vertexes and edges are each in a curved surface shape, and having a portion that can be taken as a straight line on the outer periphery of its projected image, the edges and the vertexes at which the adjacent faces cross are composed of a curved surface, and the radius of curvature of the curved face is smaller than the radius of curvature of spherical magnetic powder having the same particle diameter, so that charges can be discharged at a proper rate from the vertexes or the edges at which charges are easily concentrated.

Therefore, the magnetic powder makes it possible to prevent the charge-up of the magnetic toner while making it more difficult for charges to leak when it is involved in the magnetic toner, as compared with the magnetic powder, whose vertexes and edges are not each in a curved surface shape.

The inventors have also examined the size of the magnetic powder. As a result, they have found out that the average particle diameter of the magnetic powder must be 0.01 to 0.50 μm due to the following problems:

(1) In magnetic powder having an average particle diameter of less than 0.01 μm, the ratio of the magnetic powder exposed to surfaces of toner particles is increased, and charges are discharged from the exposed magnetic powder, causing deficiency in charging of the magnetic toner, resulting in lowered image density.

(2) On the other hand, in magnetic powder having an average particle diameter exceeding 0.50 μm, the ratio of the magnetic powder exposed to surfaces of toner particles is reduced, and charges discharged from the exposed magnetic powder are reduced, causing charge-up of the magnetic toner, resulting in lowered image density particularly when image formation is repeated.

Consequently, the present invention provides magnetic toner characterized in that toner particles formed of binder resin involves magnetic powder having an average particle diameter of 0.01 to 0.5 μm, and having the particle shape of an octahedron that is a convex polyhedron surrounded by eight triangles as a basis, each of the vertexes and edges of the octahedron being in a curved surface shape, and having a portion that can be taken as a straight line on the outer periphery of its projected image.

Considering that the effect of preventing the foregoing problems (1) and (2) from arising is further improved, it is preferable that the average particle diameter of the magnetic powder is particularly 0.05 to 0.35 μm in the above-mentioned range. Considering that good magnetic properties are provided to the magnetic toner, it is preferable that used as the magnetic powder is formed of magnetite (triiron tetroxide) containing at least one type of element selected from Mn, Zn, Ni, Cu, Al, Ti, and Si that is 0.1 to 10 atom % of Fe. From the same reason, it is preferable that the content of the magnetic powder in the toner particles is 35 to 60 mass %.

It is preferable that the magnetic toner according to the present invention is employed for an image forming method comprising the steps of forming a thin layer of magnetic toner on a surface of a developer carrying member that is rotated and that is contained a fixed magnet therein, and scattering the magnetic toner on a surface of a latent image holding member for holding an electrostatic latent image from the thin layer in a state where the developer carrying member and the latent image holding member are opposed to each other with a clearance held there between such that the thin layer and the surface of the latent image holding member are not brought into contact with each other, to develop the electrostatic latent image into a toner image.

Furthermore, the present invention provides an image forming method characterized by comprising the steps of forming a thin layer of the magnetic toner as set forth in the claim 1 on a surface of a developer carrying member that is rotated with a fixed magnet contained therein, and scattering the magnetic toner on a surface of a latent image holding member for holding an electrostatic latent image from the thin layer in a state where the developer carrying member and the latent image holding member are opposed to each other with a clearance held there between such that the thin layer and the surface of the latent image holding member are not brought into contact with each other, to develop the electrostatic latent image into a toner image.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

<<Magnetic Toner>>

<Magnetic Powder>

Figure 1:
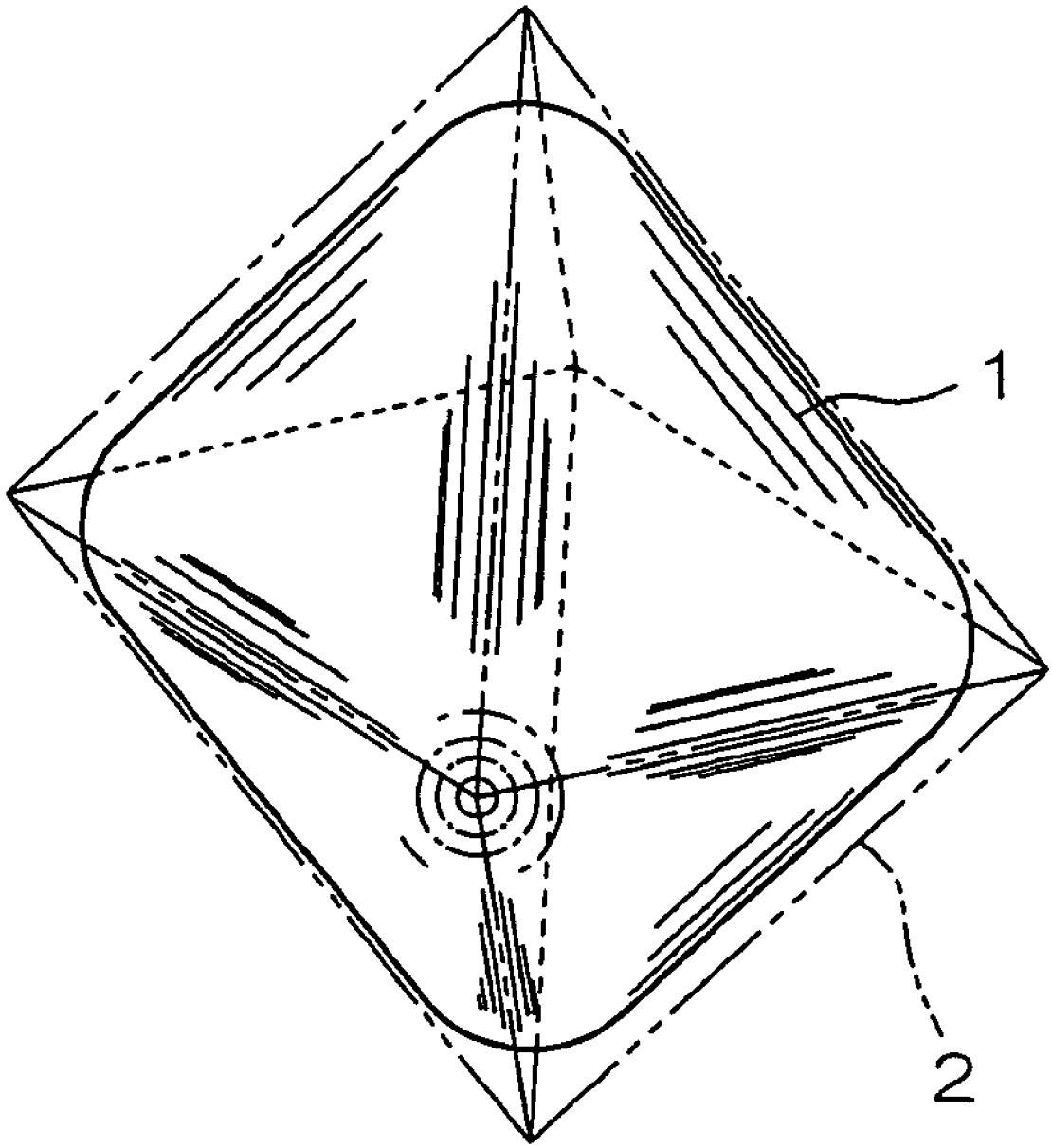
FIG. 1 is a perspective view schematically showing the shape of magnetic powder contained in magnetic toner according to the present invention.
Figure 2:
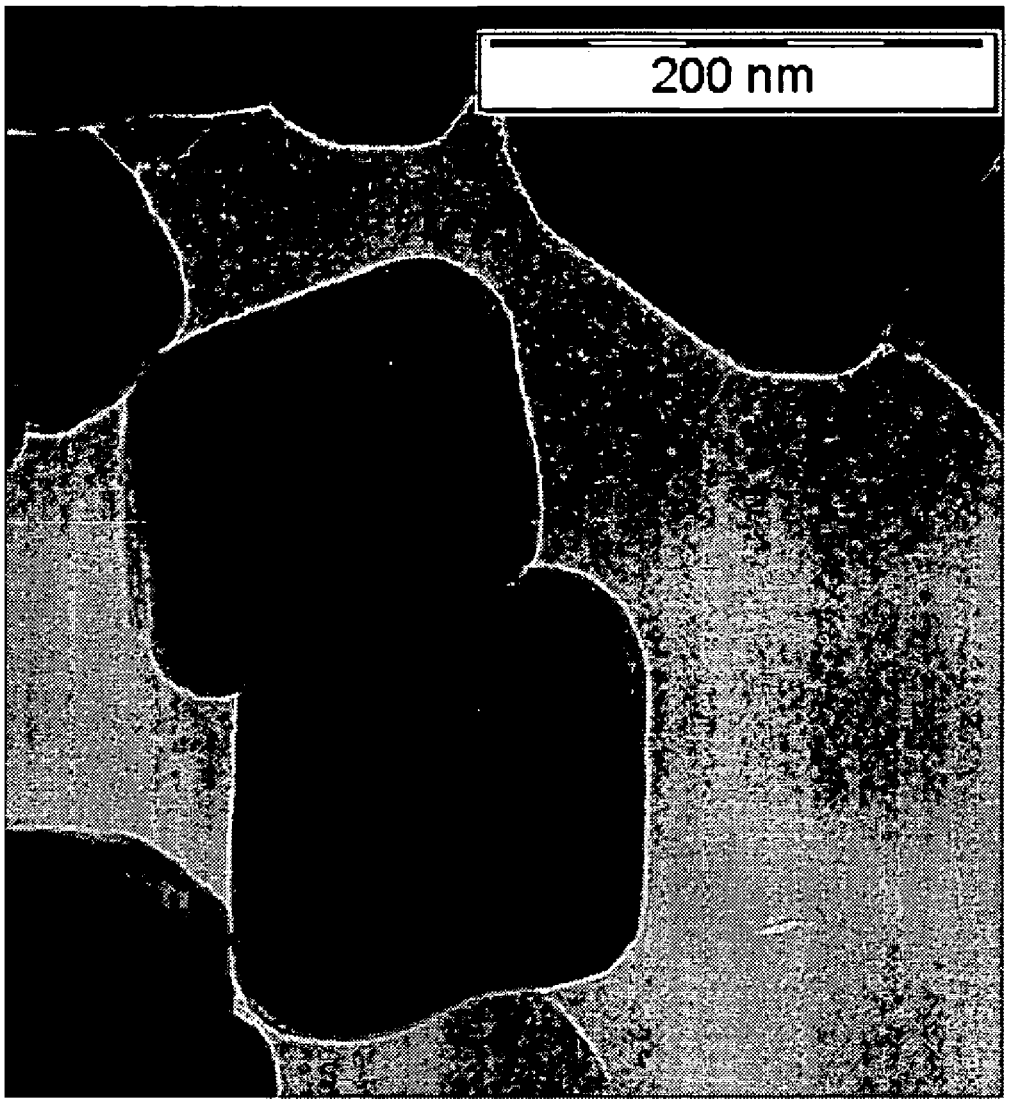
FIG. 2 is an electron magnetograph showing an example of the magnetic powder shown in FIG. 1.
Figure 3:
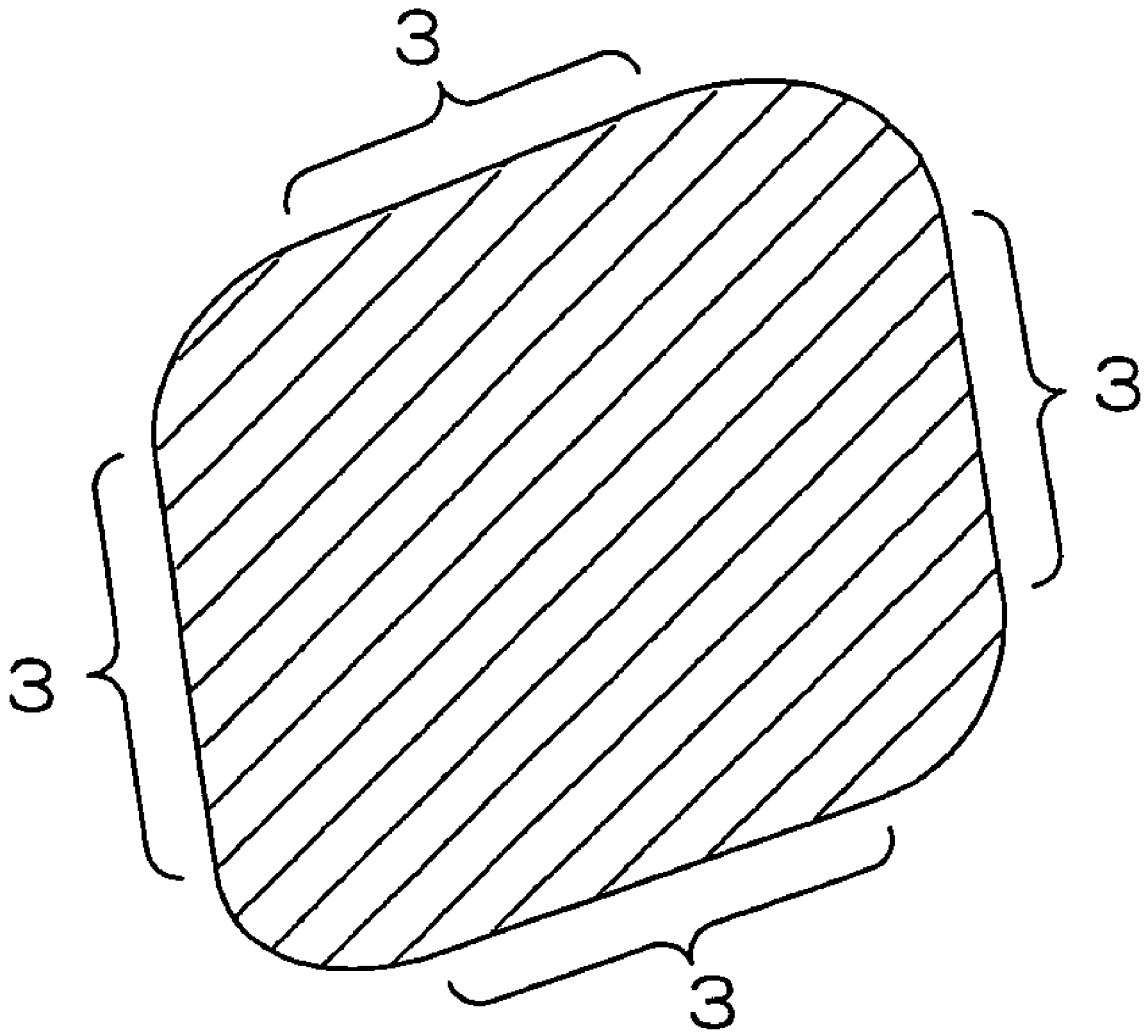
FIG. 3 is a diagram showing a projected image of the magnetic powder shown in FIG. 2 in simplified fashion.

Used as magnetic powder 1 is magnetic powder having the particle shape of an octahedron 2 that is a convex polyhedron surrounded by eight triangles, indicated by a two-dot and dash line and a broken line in FIG. 1, as a basis, each of the vertexes and edges of the octahedron 2 being in a curved surface shape, as indicated by a solid line in FIG. 1, and having a portion 3 that can be taken as a straight line on the outer periphery of a picture (a projected image) taken using a transmission electron microscope (TEM), as shown in FIG. 2, for example, as also shown in FIG. 3 showing the projected image in simplified fashion.

The magnetic powder 1 does not cause charges to leak when it is involved in magnetic toner, and is superior in fluidity and dispersibility to binder resin and is easy to uniformly disperse in binder resin, as previously described, because it has no pointed vertexes and edges serving as points at which charges are discharged. Therefore, the magnetic toner can be made uniform in the ease of charging, the charging amount, and so on by preventing variations in the dispersed state of the magnetic powder from occurring among toner particles.

Since the basic shape of the magnetic powder 1 is an octahedron, adjacent faces with any one of the vertexes or edges interposed there between or adjacent edges with any one of the vertexes interposed there between both constitute the octahedron always cross at acute angles of less than 90 degrees. Charges are easily concentrated on the vertexes at which the adjacent faces or edges cross at acute angles or the edges at which the adjacent faces cross at acute angles. Moreover, the magnetic powder 1 has the portion 3 that can be taken as a straight line on the outer periphery of the projected image, and the edges and the vertexes, at which the adjacent faces cross, of the octahedron is composed of a curved surface. However, the radius of curvature of the curved surface is smaller than the radius of curvature of spherical magnetic powder having the same particle diameter as that of the octahedral magnetic powder. Therefore, the magnetic powder 1 allows charges to be discharged at a proper rate from the vertexes or the edges at which charges are easily concentrated.

The magnetic powder 1 must have an average particle diameter of 0.01 to 0.50 μm. In magnetic powder having an average particle diameter of less than 0.01 μm, the ratio of the magnetic powder exposed to surfaces of toner particles is increased, and charges are discharged from the exposed magnetic powder, causing deficiency in charging of magnetic toner, resulting in lowered image density.

On the other hand, in magnetic powder having an average particle diameter exceeding 0.50 μm, the ratio of the magnetic powder exposed to surfaces of toner particles is reduced, and an amount of charges discharged from the exposed magnetic powder is reduced, causing charge-up of magnetic toner, resulting in lowered image density particularly when image formation is repeated.

Considering that the effect of preventing the problems from arising is further improved, the average particle diameter of the magnetic powder is preferably 0.05 to 0.35 μm and more preferably 0.15 to 0.30 μm particularly in the above-mentioned range.

The average particle diameter of the magnetic powder is the average value of the Martin's diameters (diameters corresponding to a circle) of 300 magnetic powders appearing on a picture obtained by magnifying an electron magnetograph (×10000 magnification) taken by a transmission electron microscope four times.

Examples of the magnetic powder include:

a metal exhibiting ferromagnetism such as iron, cobalt, nickel, or its alloy, or a compound containing these elements, an alloy containing no ferromagnetic element but exhibiting ferromagnetism by performing suitable heat treatment, or chromium dioxide.

Among them, magnetic powder formed of ferrite or magnetite is preferable. Particularly considering that good magnetic properties are provided to magnetic toner, it is preferable that the magnetic powder formed of magnetite containing at least one type of element selected from Mn, Zn, Ni, Cu, Al, Ti, and Si that is 0.1 to 10 atom % of Fe.

The magnetic powder composed of the magnetite, having the shape of an octahedron, whose vertexes and edges are each in a curved surface shape, having a portion that can be taken as a straight line on the outer periphery of its projected image, and having an average particle diameter defined within the range previously described can be produced by the following method, for example.

That is, 26.7 liters of an aqueous solution of a ferrous sulfate salt containing 1.5 mol/liters of $Fe^{2+}$ is added to 25.9 liters of a 3.4 N sodium hydroxide solution (corresponding to an equivalent amount of 1.10 with respect to $Fe^{2+}$) that has been contained in a reaction chamber in advance, and are heated to 90° C., to produce a ferrous-salt suspension containing a ferrous hydroxide colloid while maintaining the pH at 10.5.

100 liters per minute of air is blown in for 80 minutes while maintaining the liquid temperature of the suspension at 90° C., to perform oxidation reaction until the oxidation reaction ratio of a ferrous salt amounts to 60%.

A sulfate solution is added to the suspension such that the pH thereof becomes 6.5, and 100 liters per minute of air is then blown in for 50 minutes while maintaining the liquid temperature at 90° C., to produce magnetite particles in the suspension.

A sodium hydroxide solution is added to the suspension containing the magnetite particles such that the pH thereof becomes 10.5, and 100 liters per minute of air is then blown in for 20 minutes while maintaining the liquid temperature at 90° C., and produced magnetite particles are rinsed, filtered, and dried, to grind an aggregation of the magnetite particles. Consequently, magnetic powder composed of the magnetite particles having the particle shape of an octahedron as a basis, each of the vertexes and edges of the octahedron being in a curved surface shape, is synthesized.

When the above-mentioned synthetic reaction is performed, various types of water-soluble metal compounds such as a water-soluble silicate is added to an alkali hydroxide solution or a ferrous salt reaction solution containing a ferrous hydroxide colloid at a ratio of 0.1 to 10 atom % to Fe in terms of each of metals, and the pH of the solution in a case where blowing of oxygen-containing gas (e.g. air) is started is adjusted to 8.0 to 9.5 in the reaction in the first stage, the magnetic powder to be synthesized is composed of magnetite containing at least one type of element selected from Mn, Zn, Ni, Cu, Al, Ti, and Si at the above-mentioned predetermined ratio to Fe.

The ratio of the magnetic powder in the toner particles is preferably 35 to 60 mass % and more preferably 35 to 55 mass %. When the ratio of the magnetic powder is less than this range, the effect of holding a thin layer of the magnetic toner on a surface of the developer carrying member by a magnetic force of a fixed magnet contained in the developer carrying member is weakened, so that fogging may occur particularly when image formation is repeated. When the ratio of the magnetic powder exceeds this range, the effect of holding the thin layer of the magnetic toner on the surface of the developer carrying member is conversely made too strong, so that image density may be reduced. Since the ratio of the binder resin is relatively lowered, the fixing properties of the magnetic toner to a surface of a material to be printed such as paper and the durability thereof may be degraded.

Considering that the magnetic powder is satisfactorily dispersed in the binder resin, it may be subjected to surface treatment using surface treating agents such as a titanium coupling agent, a silane coupling agent, aluminum coupling agent, and various types of fatty acids. Among them, the silane coupling agent is preferable. Examples of a specific compound of the silane coupling agent include hexamethyldisilazane, trimethylsilane, trimethylchlorosilane, trimethyl ethoxysilane, dimethyldichlorosilane, methyltrichlorosilane, allyldimethylchlorosilane, allylphenyldichlorosilane, benzyldimethylchlorosilane, bromomethyldimethylchlorosilane, α-chlorethyltrichlorosilane, β-chlorethyltrichlorosilane, chloromethyldimethylchlorosilane, triorganosilylmercaptan, trimethylsilylmercaptan, triorganosilylacrylate, vinyldimehyl acetoxysilane, dimethyl diethoxysilane, dimethyl dimethoxysilane, diphenyl ethoxysilane, hexamethyldisiloxane, 1,3-divinyl tetramethyldisiloxane, and 1,3-diphenyl tetramethyldisiloxane. Further, it is also possible to use dimethyl polysiloxane having two to twelve siloxane units per one molecule and containing hydroxyl groups respectively coupled to silicon atoms in the siloxane unit positioned at its end.

<Binder Resin>

Examples of the binder resin include polystyrene resins, acrylic resins, polyethylene resins, polypropylene resins, polyvinyl chloride resins, polyester resins, polyamide resins, polyurethane resins, polyvinyl alcohol resins, vinyl ether resins, N-vinyl resins, and styrene-butadiene resins. Particularly, polystyrene resins and polyester resins are preferable.

Examples of the polystyrene resins include a binary or ternary copolymer or a copolymer having four or more elements of styrene and another monomer in addition to a homopolymer of styrene. Examples of other monomers that can be copolymerized with styrene include one type or two or more types of p-chlorostyrene; vinyl naphthalene; ethylene unsaturated monoolefins such as ethylene, propylene, butylenes, and isobutylene; halogenated vinyls such as vinyl chloride, vinyl bromide, and vinyl fluoride; vinyl esters such as vinyl acetate, vinyl propionate, vinyl benzoate, and vinyl butyrate; (meth-)acrylic esters such as methyl acrylate, ethyl acrylate, n-butyl acrylate, isobutyl acrylate, dodecyl acrylate, n-octyl acrylate, 2-chloroethyl acrylate, phenyl acrylate, α-chloro methyl acrylate, methyl methacrylate, ethyl methacrylate, and butyl methacrylate; other acrylic acid derivatives such as acrylonitrile, methacrylonitrile, and acrylamide; vinyl ethers such as vinyl methyl ether and vinyl isobutyl ether; vinyl ketons such as vinyl methyl ketone, vinyl ethyl ketone, and methyl isopropenyl ketone; N-vinyl compounds such as N-vinyl pyrrole, N-vinyl carbazole, N-vinyl indole, N-vinyl pyrrolidone, and so on.

Examples of the polyester resin include various types of polyester resins obtained by condensation polymerization or co-condensation polymerization of an alcohol component and a carboxylic acid component. Examples of the alcohol component include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,4-cyclohexanedimethanol, dipropylene glycol, polyethylene glycol, polypropylene glycol, polytetramethylene glycol, 1,6-hexanediol, and 1,8-octanediol; bisphenols such as bisphenol A, hydrogenated bisphenol A, polyoxyethylenated bisphenol A, and polyoxypropylenated bisphenol A; alcohols having three or more hydroxyl groups such as sorbitol, 1,2,3,6-hexanetetrol, 1,4-sorbitan, pentaerythritol, dipentaerithritol, tripentaerythritol, 1,2,4-butanetriol, 1,2,5-pentanetriol, glycerin, diglycerin, 2-methylpropanetriol, 2-methyl-1,2,4-butanetriol, trimethylolethane, trimethylolpropane, 1,3,5-trihydroxymethylbenzene; and so on.

Examples of the carboxylic acid component include acids having two carboxyl groups such as oxalic acid, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acid (n-butyl succinic acid, isobutyl succinic acid, n-octyl succinic acid, n-dodecyl succinic acid, isododecyl succinic acid, etc.), alkenyl succinic acid (n-butenyl succinic acid, isobutenyl succinic acid, n-octenyl succinic acid, n-dodecenylsuccinic acid, isododecenylsuccinic acid, etc.); and acids having three or more carboxyl groups such as 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylene carboxypropane, 1,2,4-cyclohexanetricarboxylic acid, tetra (methylene carboxyl) methane, 1,2,7,8-octanetetracarboxylic acid, pyromellitic acid, and enpol trimer acid; and so on.

Considering that the magnetic toner according to the present invention is satisfactorily fixed to a surface of a material to be printed such as paper by heat fixing means used in a normal image forming apparatus, the softening point of polyester resin is preferably 80 to 150° C. and more preferably 90 to 140° C.

It is preferable that a part of the binder resin has a cross-linking structure. Preservation stability and form holding properties, durability, and so on of the magnetic toner can be improved without degrading fixing properties by introducing a cross-linking structure into a part of the binder resin. In order to cause a part of the binder resin to have a cross-linking structure, a cross-linking agent may be added to crosslink the resin, or thermosetting resin may be blended.

Examples of the thermosetting resin include one type or two or more types of epoxy resins such as bisphenol A-type epoxy resin, hydrogenated bisphenol A-type epoxy resin, novolac-type epoxy resin, polyalkylene ether-type epoxy resin, and cyclic aliphatic-type epoxy resin; cyanate resin; and so on.

The glass transition temperature Tg of the binder resin is preferably 50 to 65° C. and more preferably 50 to 60° C. In a case where the glass transition temperature is less than this range, toner particles may be easily welded to one another, so that preservation stability may be degraded. Further, the strength of the resin is low, so that there may occur such a phenomenon that the resin adheres to a surface of a latent image holding member, not to be separated therefrom, so-called toner adhesion. Conversely, when the glass transition temperature exceeds this range, the fixing properties to a surface of a material to be printed such as paper may be degraded.

The glass transition temperature of the binder resin can be found from a change point of specific heat in an endothermic curve measured using a differential scanning calorimeter (DSC), for example. Specifically, the glass transition temperature of the binder resin can be found from a change point of specific heat in an obtained endothermic curve by putting 10 mg of a measuring sample in an aluminum pan using a differential scanning calorimeter DSC-6200 manufactured by Seiko Instruments Inc., for example, as well as using a hollow aluminum pan as a reference to make measurements under normal temperature and normal pressure in a measurement temperature range of 25 to 200° C. and at a temperature rise speed of 10° C./min.

Various types of additives conventionally known such as a coloring agent, a charge-controlling agent and waxes can be also contained in the magnetic toner according to the present invention. Examples of the coloring agent include pigments such as carbon black and dyes such as Acid Violet. It is preferable that the ratio of the coloring agent in the toner particles is 0.5 to 5 mass %.

<Charge-Controlling Agent>

A charge-controlling agent is blended in order to improve the charging level of the magnetic toner and the charging rise characteristics thereof (an index indicating whether or not the magnetic toner is charged at a predetermined charge level in a short time period) as well as to improve durability and stability. Examples of the charge-controlling agent include one having positive charging properties and one having negative charging properties. Either one of them is blended in conformity with the charging polarity of the magnetic toner.

Examples of the charge-controlling agent having positive charging properties include one type or two or more types of azine compounds such as pyridazine, pyrimidine, pyrazine, ortho-oxazine, meta-oxazine, para-oxazine, ortho-thazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes composed of azine compounds such as azine FastRed FC, azine FastRed 12BK, azine Violet BO, azine Brown 3G, azine Light Brown GR, azine Dark Green BH/C, azine Deep Black EW, and azine Deep Black 3RL; nigrosine compounds such as nigrosine, a nigrosine salt, and a nigrosine derivative; acid dyes composed of nigrosine compounds such as nigrosine BK, nigrosine NB, and nigrosine Z; metal salts of naphthenic acid or higher fatty acid; alkoxylated amine; alkylamido; quaternary ammonium salts such as benzylmethylhexyldecylammonium, and decyltrimethylammonium chloride; and so on. Particularly, the nigrosine compound is suitable as toner having positive charging properties because more quick charging rise characteristics are obtained.

Usable as the charge-controlling agent having positive charging properties are also resin or oligomer having a quaternary ammonium salt, resin or oligomer having a carboxylate salt, resin or oligomer having a carboxyl group, and so on. Specifically, examples are one type or two or more types of polystyrene resin having a quaternary ammonium salt, acrylic resin having a quaternary ammonium salt, styrene-acrylic resin having a quaternary ammonium salt, polyester resin having a quarternary ammonium salt, polystyrene resin having a carboxylate salt, acrylic resin having a carboxylate salt, styrene-acrylic resin having a carboxylate salt, polyester resin having a carboxylate salt, polystyrene resin having a carboxyl group, acrylic resin having a carboxyl group, styrene-acrylic resin having a carboxyl group, polyester resin having a carboxyl group, and so on.

Particularly, styrene-acrylic resin (a styrene-acrylic copolymer) having a quaternary ammonium salt, a carboxylate salt, or a carboxyl group as a functional group is suitable because the charging amount thereof can be easily adjusted to a value within a desired range. Examples of acrylic monomers, together with styrene, composing styrene-acrylic resin include alkyl (meth-)acrylate esters such as methyl acrylate, ethyl acrylate, n-propyl acrylate, isopropyl acrylate, n-butyl acrylate, isobutyl acrylate, 2-ethylhexyl acrylate, methyl methacrylate, ethyl methacrylate, n-butyl methacrylate, and isobutyl methacrylate.

Furthermore, used as the quaternary ammonium salt compound is a unit to be induced from dialkylaminoalkyl (meth-)acrylate via quaternization. Examples of the dialkylaminoalkyl (meth-)acrylate to be induced include di(lower alkyl) aminoethyl (meth-)acrylates such as dimethylaminoethyl (meth-)acrylate, diethylaminoethyl (meth-)acrylate, dipropylaminoethyl (meth-)acrylate, and dibutylaminoethyl (meth-)acrylate; dimethylmethacrylamido; and dimethylaminopropylmethacrylamido. Further, polymerizable monomers containing a hydroxyl group such as hydroxyehtyl (meth-)acrylate, hydroxypropyl (meth-)acrylate, 2-hydroxybutyl (meth-)acrylate, and N-methylol (meth-)acrylamido can be simultaneously used at the time of polymerization.

Effective as the charge-controlling agent having negative charging properties are organic metal complexes and chelate compounds, for example. Among them, an acetylacetone metal complex, a salicylic acid metal complex, or a salt is preferable. Particularly, the salicylic acid metal complex or the salt is preferable. Examples of the acetylacetone metal complex include aluminum acetylacetonate and iron (II) acetylacetonate. Examples of the salicylic acid metal complex or the salt include chromium 3,5-di-tert-butyl salicylate.

The ratio of the charge-controlling agent in the toner particles is preferably 0.5 to 15 mass %, and more preferably 0.5 to 8.0 mass %, and particularly preferably 0.5 to 7.0 mass %. When the ratio of the charge-controlling agent is less than this range, it is difficult to provide stable charging properties to the magnetic toner, so that image density may be lowered, and durability may be degraded. Conversely, when the ratio exceeds this range, inferior charging and inferior images are liable to occur under environmental resistance of the magnetic toner and particularly, under a high-temperature and high-humidity environment, and inferior dispersion in the binder resin is liable to occur. The inferior dispersion may cause fogging. Further, the charge-controlling agent that has aggregated without being dispersed may contaminate a photoreceptor.

<Wax>

Wax is blended in order to improve the fixing properties of the magnetic toner on a surface of a material to be printed such as paper, prevent such offset that the magnetic toner at the time of fixing adheres to a fixing roller or the like in an image forming apparatus to improve offset resistance, and prevent such image smearing that the magnetic toner that has adhered to the fixing roller or the like adheres to the surface of the material to be printed again to make images dirty.

As the wax, one type or two or more types of olefin waxes such as polyethylene wax and polypropylene wax; vegetable waxes such as carnauba wax, rice wax, and candelilla wax; mineral waxes such as montan wax; Fisher-Tropsch waxes produced by a Fisher-Tropsch method from coal, natural gas, etc.; petroleum waxes such as paraffin wax and microcrystalline wax; ester waxes; TEFLON waxes, etc., for example, can be selected and used.

It is preferable that the ratio of the wax in the toner particles is 1 to 5 mass %. In a case where the ratio of the wax is less than this range, the effect of improving anti-offset properties of magnetic toner and preventing image smearing may be insufficient. Conversely, in a case where the ratio of the wax exceeds this range, toner particles may be welded to one another to reduce preservation stability.

<Production of Magnetic Toner>

The magnetic toner according to the present invention is produced by mixing the foregoing components using an agitating and mixing machine such as a HENSCHEL mixer, then kneading them using a kneading machine such as an extruder, followed by cooling, and further grinding as well as classifying them as required. The foregoing components may be wet-mixed. It is preferable that the center particle diameter on the volume basis of the magnetic toner according to the present invention thus produced is 5 to 10 μm.

In order to improve fluidity, preservation stability, cleaning properties indicating ease of cleaning and removal from a surface of a latent image holding member, and so on, its surface may be subjected to surface treatment using fine particles of colloidal silica, hydrophobic silica, alumina, titanium oxide, or the like (an external additive, generally having an average particle diameter of not more than 1.0 μm), for example, as required. In the surface treatment, it is preferable that the magnetic toner and the external additive are dry-mixed. Particularly in order to prevent the external additive from being embedded in surfaces of toner particles, they are preferably mixed using a HENSCHEL mixer, a Nauter mixer, or the like. It is preferable that the amount of addition of the external additive to the toner particles is 0.2 to 10.0 mass %. Further, the external additive may be subjected to surface treatment using aminosilane, silicone oil, a silane coupling agent (hexamethyldisilazane, etc.), a titanium coupling agent, or the like, as required.

It is preferable that the magnetic toner according to the present invention is employed for an image forming method comprising the steps of forming a thin layer of the magnetic toner on a surface of a developer carrying member that is rotated and that is contained a fixed magnet therein, and scattering the magnetic toner on a surface of a latent image holding member for holding an electrostatic latent image from the thin layer in a state where the developer carrying member and the latent image holding member are opposed to each other with a clearance held there between such that the thin layer and the surface of the latent image holding member are not brought into contact with each other, to develop the electrostatic latent image into a toner image, that is, a magnetic one-component jumping developing method.

<<Image Forming Method>>

An image forming method according to the present invention is characterized by comprising the steps of forming a thin layer of the magnetic toner according to the present invention on a surface of a developer carrying member that is rotated and that is contained a fixed magnet therein, and scattering the magnetic toner on a surface of a latent image holding member for holding an electrostatic latent image from the thin layer in a state where the developer carrying member and the latent image holding member are opposed to each other with a clearance held there between such that the thin layer and the surface of the latent image holding member are not brought into contact with each other, to develop the electrostatic latent image into a toner image.

The image forming method according to the present invention can be carried out as in the conventional example. For example, as the latent image holding member, various types of organic or inorganic photoreceptors conventionally known can be employed.

Examples of the inorganic photoreceptors include one having a photosensitive layer composed of a thin film of an inorganic photoconductive material such as selenium, selenium-tellurium, selenium-arsenic, and cadmium sulfide formed on a conductive base.

Examples of the organic photoreceptors include ones having an organic photosensitive layer of a single layer type or a laminated type formed on a conductive base. Examples of the single layer-type photosensitive layer include ones having a charge generating agent, a charge transporting agent, or the like dispersed in binder resin. Examples of the laminated-type photosensitive layer include one in which a charge generating layer composed of a charge generating agent and a charge transporting layer having a charge transporting agent dispersed in binder resin are laminated in this order or in the opposite order.

Usable as the developer carrying member are one composed of various types of materials conventionally known. Particularly, it is preferable that a developer carrying member made of aluminum or stainless steel is used.

In order to hold the electrostatic latent image on the surface of the photoreceptor serving as the latent image holding member, the surface of the photoreceptor may be uniformly charged using a scorotron charger or the like, as in the conventional example and then exposed by exposure means such as a semiconductor laser or a light-emitting diode, to remove charges in an exposed portion.

In order to transfer a toner image formed on the surface of the photoreceptor on a surface of a material to be printed, a corona charger, a serrated electrode, a transfer roller, or the like, for example, is used. Particularly, the transfer roller is preferable.

As the transfer roller, a roller composed of a soft foam such as foamed EPDM, for example, is preferable. When the roller composed of the foam is used as the transfer roller, toner that has adhered to the transfer roller enters air bubbles of the foam when paper is jammed, for example, thereby making it possible to prevent the reverse of the material to be printed from being made dirty, for example, when driving is resumed. Consequently, the necessity of cleaning the transfer roller is eliminated, thereby making it possible to reduce initial costs and running costs.

It is preferable that the hardness of the transfer roller composed of the soft foam is 30 to 40 degrees in terms of Ascar C Hardness. When the hardness of the transfer roller is lower than this range, inferior transfer may occur. Conversely, when the hardness of the transfer roller is higher than this range, a nip between the transfer roller and the photoreceptor is reduced, so that a conveyance force of the material to be printed may be lowered.

It is preferable that the transfer roller is rotated with a line speed difference of 3 to 5% from the surface of the photoreceptor in a state where it is brought into contact with the surface of the photoreceptor. When the line speed difference is less than 3%, the transfer properties of the toner image is degraded, so that partial character missing may occur, for example. When the line speed difference exceeds 5%, a slip amount from the surface of the photoreceptor is increased, so that the shift of a transfer image, so-called jitter may be increased.

It is preferable that used as cleaning means for cleaning and removing the magnetic toner remaining on the surface of the photoreceptor is an elastic blade pressed against the surface of the photoreceptor. Usable as the elastic blade are various types of elastic blades conventionally known composed of rubber, soft resin, or the like. Specifically, examples are elastic blades composed of silicone rubber, fluorocarbon rubber, urethane rubber, urethane resin, and so on. It is preferable that the elastic blade is pressed at a line pressure of 10 to 50 g/cm, considering that the toner is satisfactorily cleaned and removed and no indentation or the like is produced on the surface of the photoreceptor.

EXAMPLES

<<Examination of Shape of Magnetic Powder I>>

(Measurement of Average Particle Diameter)

The Martin's diameters (diameters corresponding to a circle) of 300 magnetic powders appearing on a picture obtained by magnifying an electron magnetograph (×10000 magnification) taken by a transmission electron microscope four times, and the average value of the measured Martin's diameters was found and taken as the average particle diameter of the magnetic powders.

Example 1

<Synthesis of Binder Resin>

845 mass parts of styrene, 155 mass parts of n-butyl acrylate, and 8.5 mass parts of di-tert-butyl peroxide were dissolved in 125 mass parts of xylene under a nitrogen atmosphere, to prepare a solution.

300 mass parts of xylene was put in a reaction chamber in which a thermometer, an agitating machine, a nitrogen introducing pipe, and a reflux condenser are connected to the reaction chamber, the previously prepared solution was dropped into the reaction chamber in three hours while heating the reaction chamber to maintain the liquid temperature at 170° C. while continuously introducing nitrogen from the nitrogen introduction pipe, the solution was further agitated for one hour at 170° C. after the dropping was terminated, and a solvent was then removed, to prepare a styrene-n-butyl acrylate copolymer serving as binder resin.

<Production of Magnetic Toner>

Used as the magnetic powder is magnetic powder having an average particle diameter of 0.22 μm, composed of magnetite containing Zn at a ratio of 1.1 atom % to Fe, having the particle shape of a octahedron that is a convex polyhedron surrounded by eight triangles as a basis, each of the vertexes and edges of the octahedron being in a curved surface shape, and having a portion that can be taken as a straight line on the outer periphery of its projected image, as shown in FIGS. 1 to 3.

49 mass parts of the binder resin previously synthesized, 45 mass parts of the magnetic powder, 3 mass parts of Fisher-Tropsch wax (Sasol Wax H1 produced by Sasol Chemcal Industries, Ltd.] serving as a release agent, 3 mass parts of a quaternary ammonium salt [BONTRON P-51 produced by Orient Chemical Industries, Ltd.] serving as a positive charge-controlling agent were mixed using a HENSCHEL mixer, were kneaded using a biaxial extruder, were cooled, and were coarsely ground using a hammer mill. They were then finely ground using a mechanical grinder, and were classified using an air current classifier, to produce magnetic toner having a center particle diameter on the volume basis of 8.0 μm.

Comparative Example 1

Magnetic toner having a center particle diameter on the volume basis of 8.0 μm was produced in the same manner as that in the example 1 except that used as the magnetic powder was the same amount of magnetic powder, having an average particle diameter of 0.22 μm, composed of magnetite having the same composition as that used in the example 1, having the particle shape of an octahedron that is a convex polyhedron surrounded by eight triangles as a basis, each of the vertexes and edges of the octahedron not being in a curved surface shape.

Comparative Example 2

Magnetic toner having a center particle diameter on the volume basis of 8.0 μm was produced in the same manner as that in the example 1 except that used as the magnetic powder was the same amount of magnetic powder, having an average particle diameter of 0.24 μm, composed of magnetite having the same composition as that used in the example 1, and having the particle shape of an octahedron that is a convex polyhedron surrounded by eight triangles as a basis, each of the vertexes and edges of the octahedron being in a curved surface shape, and not having a portion that can be taken as a straight line on the outer periphery of its projected image.

Comparative Example 3

Magnetic toner having a center particle diameter on the volume basis of 8.0 μm was produced in the same manner as that in the example 1 except that used as the magnetic powder was the same amount of magnetic powder, having an average particle diameter of 0.20 μm, composed of magnetite having the same composition as that used in the example 1, having the particle shape of an octahedron that is a convex polyhedron surrounded by eight triangles, each of the vertexes and edges of the octahedron being chamfered at a plane smaller than each of faces constituting the octahedron, as shown in FIG. 6 (b) in JP11-153882A (1999).

Comparative Example 4

Magnetic toner having a center particle diameter on the volume basis of 8.0 μm was produced in the same manner as that in the example 1 except that used as the magnetic powder was the same amount of magnetic powder, having an average particle diameter of 0.20 μm, composed of magnetite having the same composition as that used in the example 1, having the particle shape of a cube, each of the vertexes and edges not being in a curved surface shape.

Comparative Example 5

Magnetic toner having a center particle diameter on the volume basis of 8.0 μm was produced in the same manner as that in the example 1 except that used as the magnetic powder was the same amount of magnetic powder, having an average particle diameter of 0.20 μm, composed of magnetite having the same composition as that used in the example 1, having the particle shape of a cube, each of the vertexes and edges of the cube being chamfered at a plane smaller than each of faces constituting the cube, as shown in FIG. 6 (f) in JP11-153882A (1999).

Comparative Example 6

Magnetic toner having a center particle diameter on the volume basis of 8.0 μm was produced in the same manner as that in the example 1 except that used as the magnetic powder was the same amount of magnetic powder composed of magnetite having the same composition as that used in the example 1, having the particle shape of a sphere, and having an average particle diameter of 0.22 μm.

1.0 mass part of silica [RA-200H produced by NIPPON AEROSIL CO., LTD.] and 2.0 mass parts of titanium oxide [EC-100 produced by TITAN KOGYO KABUSHIKI KAISHA] were added to 100 mass parts of the magnetic toner in each of the example and the comparative examples, and were mixed using a Henschel mixer, and were then used for a complex machine using a magnetic one-component jumping developing system [KM-1650 manufactured by KYOCERA MITA CORPORATION simultaneously having the respective functions of a laser printer, an electrostatic copying machine, and a normal paper facsimile device, line speed of photoreceptor: 100 mm/s, line speed of developer carrying member: 160 mm/s] equipped with an organic photoreceptor as a latent image holding member to actually form images, to evaluate the following properties. Usable as the developer carrying member was one made of SUS305 having a diameter of 20 ϕ and having a ten-point average surface roughness Rz of 4.0 μm.

(A) Normal Temperature and Normal Humidity Test:

The complex machine was caused to stand still for eight hours in a normal temperature and normal humidity environment of a temperature of 20° C. and a relative humidity of 65% RH to stabilize the state thereof, to then evaluate each of the following properties in the same normal temperature and normal humidity environment.

(1) Image Density:

Each of the image density of the first image (initial image) on which a standard pattern having a printing ratio of 5% was image-formed using the complex machine and the image density of an image (an image after duration) on which a standard pattern having a printing ratio of 5% was image-formed after an ISO 4% document was continuously image-formed on 100000 paper sheets were respectively measured using a Macbeth reflection density meter [RD914 manufactured by GretagMacbeth AG]. An image having an image density of not less than 1.30 was estimated to be accepted, and an image having an image density of less than 1.30 was estimated to be rejected.

(2) Fogging:

Respective blank portions of the initial image and the image after duration that have been formed in the foregoing item (1) were observed, to evaluate the presence or absence of fogging on the following basis:

○: No fogging was found.

Δ: Fogging was slightly found.

x: Strong fogging was found.

(3) Toner Charging Amount:

A toner charging amount μC/g in a thin layer of toner formed on a surface of a developer carrying member was measured using a charging amount measuring device [Q/M meter 210HS manufactured by TREK, INC.] at the time of initial image formation and after continuous image formation.

(4) Layer Non-Uniformity (the State of Thin Layer of Toner)

The state of a thin layer of toner formed on a surface of a developer carrying member was observed and estimated on the following basis at the time of initial image formation and after continuous image formation.

○: The thin layer was uniform so that no irregularities were observed.

Δ: Slight irregularities were found on the thin layer but did not affect the formed image.

x: Irregularities were found on the thin layer and affected the formed image. Particularly, density non-uniformity was observed in a solid image portion.

(B) High-Temperature and High-Humidity Test:

The complex machine was caused to stand still for eight hours in a high-temperature and high-humidity environment of a temperature of 33° C. and a relative humidity of 85% RH to stabilize the state thereof, to then measure an image density and a toner charging amount as well as to evaluate fogging and layer non-uniformity under the same conditions as those in the items (1) to (3) previously described in the same high-temperature and high-humidity environment.

(C) Low-Temperature and Low-Humidity Test:

The complex machine was caused to stand still for eight hours in a low-temperature and low-humidity environment of a temperature of 10° C. and a relative humidity of 20% RH to stabilize the state thereof, to then measure an image density and a toner charging amount as well as to evaluate fogging and layer non-uniformity under the same conditions as those in the items (1) to (3) previously described in the same low-temperature and low-humidity environment.

The foregoing results are shown in Tables 1 to 3. Reference signs in columns listing the respective shapes of particles composing the magnetic powder in the Tables are as follows:

Octahedron-round: magnetic powder having the shape of an octahedron, whose vertexes and edges are each in a curved surface shape, and having a portion that can be taken as a straight line on the outer periphery of its projected image.

Octahedron-corner: magnetic powder having the shape of an octahedron, whose vertexes and edges are not each in a curved surface shape. A normal octahedron.

Octahedron-large round: magnetic powder having the shape of an octahedron, whose vertexes and edges are each in a curved surface shape, and not having a portion that can be taken as a straight line on the outer periphery of its projected image because the radii of curvature of a curved surface is too large.

Octahedron-chamfer: magnetic powder having the shape of an octahedron, whose vertexes and edges are each chamfered at a small plane.

Cube-corner: magnetic powder having a cubic shape whose vertexes and edges are not each in a curved surface shape. A normal cube.

Cube-chamfer: magnetic powder having the shape of a cube, whose vertexes and edges are each chamfered at a small plane.

Sphere: the shape of a sphere.

TABLE 1

| | | Normal temperature and normal humidity test (temperature 20° C., relative humidity 65% RH) | | | | | | | |
|---|---|---|---|---|---|---|---|---|---|
| | Magnetic powder | Charging amount (μC/g) | | Image density | | Fogging | | Layer non-uniformity | |
| | particle shape | At beginning | After duration | At beginning | After duration | At beginning | After duration | At beginning | After duration |
| Example 1 | Octahedron-Round | 11.8 | 13.7 | 1.42 | 1.39 | ○ | ○ | ○ | ○ |
| Comparative example 1 | Octahedron-Corner | 5.5 | 6.1 | 1.08 | 1.15 | Δ | X | ○ | ○ |
| Comparative example 2 | Octahedron-large round | 12.3 | 28.5 | 1.41 | 1.21 | ○ | ○ | ○ | ○ |
| Comparative example 3 | Octahedron-chamfer | 5.9 | 7.0 | 1.13 | 1.22 | Δ | X | ○ | ○ |
| Comparative example 4 | Cube-corner | 7.6 | 8.7 | 1.15 | 1.24 | Δ | X | ○ | ○ |
| Comparative example 5 | Cube-chamfer | 8.3 | 9.8 | 1.25 | 1.31 | Δ | X | ○ | ○ |

TABLE 1-continued

| | Magnetic powder particle shape | Normal temperature and normal humidity test (temperature 20° C., relative humidity 65% RH) Charging amount (μC/g) At beginning | After duration | Image density At beginning | After duration | Fogging At beginning | After duration | Layer non-uniformity At beginning | After duration |
|---|---|---|---|---|---|---|---|---|---|
| Comparative Example 6 | Sphere | 12.8 | 42.1 | 1.38 | 1.08 | ○ | X | ○ | Δ |

TABLE 2

| | Magnetic powder particle shape | High-temperature and high-humidity test (temperature 33° C., relative humidity 85% RH) Charging amount (μC/g) At beginning | After duration | Image density At beginning | After duration | Fogging At beginning | After duration | Layer non-uniformity At beginning | After duration |
|---|---|---|---|---|---|---|---|---|---|
| Example 1 | Octahedron-Round | 10.5 | 11.6 | 1.39 | 1.40 | ○ | ○ | ○ | ○ |
| Comparative example 1 | Octahedron-Corner | 4.1 | 4.5 | 0.80 | 0.91 | Δ | X | ○ | ○ |
| Comparative example 2 | Octahedron-large round | 10.6 | 23.6 | 1.37 | 1.26 | ○ | ○ | ○ | ○ |
| Comparative example 3 | Octahedron-chamfer | 4.6 | 5.4 | 1.00 | 1.06 | Δ | X | ○ | ○ |
| Comparative example 4 | Cube-corner | 5.1 | 5.8 | 1.05 | 1.11 | Δ | X | ○ | ○ |
| Comparative example 5 | Cube-chamfer | 5.7 | 6.8 | 1.07 | 1.12 | Δ | X | ○ | ○ |
| Comparative example 6 | Sphere | 11.8 | 38.5 | 1.38 | 1.12 | ○ | X | ○ | Δ |

TABLE 3

| | Magnetic powder Particle shape | Low-temperature and low-humidity test (temperature 10° C., relative humidity 20% RH) Charging amount (μC/g) At beginning | After duration | Image density At beginning | After duration | Fogging At beginning | After duration | Layer non-uniformity At beginning | After duration |
|---|---|---|---|---|---|---|---|---|---|
| Example 1 | Octahedron-Round | 12.7 | 14.9 | 1.42 | 1.37 | ○ | ○ | ○ | ○ |
| Comparative example 1 | Octahedron-Corner | 6.3 | 7.2 | 1.21 | 1.26 | Δ | X | ○ | ○ |
| Comparative example 2 | Octahedron-large round | 13.1 | 32.1 | 1.39 | 1.12 | ○ | ○ | ○ | ○ |
| Comparative example 3 | Octahedron-chamfer | 6.9 | 8.3 | 1.25 | 1.28 | Δ | X | ○ | ○ |
| Comparative example 4 | Cube-corner | 8.4 | 9.8 | 1.28 | 1.33 | Δ | ○ | ○ | ○ |
| Comparative example 5 | Cube-chamfer | 9.5 | 11.3 | 1.31 | 1.38 | Δ | ○ | ○ | ○ |
| Comparative example 6 | Sphere | — | — | — | — | — | — | — | — |

It was confirmed from Tables proved that in both magnetic toner in the comparative example 1 using the magnetic powder having the shape of an octahedron, whose vertexes and edges are not each in a curved surface shape and magnetic toner in the comparative example 3 using the magnetic powder having the shape of an octahedron, whose vertexes and edges are each chamfered at a small plane, the initial charging amount was significantly small, the image density was low, fogging was produced, and fogging after duration was significantly degraded in the normal temperature and normal humidity test and the high-temperature and high-humidity test, so that charged charges of the toner leaked.

Furthermore, it was confirmed that in both magnetic toner in the comparative example 4 using the magnetic powder having the shape of a cube, whose vertexes and edges are not each in a curved surface shape, and magnetic toner in the comparative example 5 using the magnetic powder having the shape of a cube, whose vertexes and edges are each chamfered at a small plane, the initial charging amount was significantly small, the image density was low, fogging was produced, and fogging after duration was significantly degraded similarly in the normal temperature and normal humidity test and the high-temperature and high-humidity test, so that charged charges of the toner leaked.

Furthermore, it was confirmed that in both magnetic toner in the comparative example 2 using the magnetic powder having the shape of an octahedron, whose vertexes and edges are each in a curved surface shape but not having a portion that can be taken as a straight line on the outer periphery of its projected image because the radii of curvature of a curved surface is too large and magnetic toner in the comparative example 6 using the spherical magnetic powder, the charging amount after duration significantly rose, the image density was lowered, and fogging was produced in the normal temperature and normal humidity test and the high-temperature and high-humidity test, so that charge-up was produced. When the magnetic toner in the comparative example 6 using the spherical magnetic powder was used, the image had already been non-uniform at the beginning in the low-temperature and low-humidity test. When the cause was examined, it was determined that the thin layer of toner was not uniformly formed on the surface of the developer carrying member. Therefore, durability evaluation was not performed.

On the other hand, it was confirmed that in magnetic toner in the example 1 using the magnetic powder having the shape of an octahedron, whose vertexes and edges are each in a curved surface shape, and having a portion that can be taken as a straight line on the outer periphery of its projected image, it was possible to keep respective charging amounts and image densities at the beginning and after duration approximately constant as well as to form a good image by preventing fogging from being produced in all the normal temperature and normal humidity test, the low-temperature and low-humidity test, and the high-temperature and high-humidity test.

<<Examination of Shape of Magnetic Powder II>>

Examples 2 to 5, Comparative Examples 7 and 8

Magnetic toner having a center particle diameter on the volume basis of 8.0 μm was produced in the same manner as that in the example 1 except that used as the magnetic powder was the same amount of magnetic powders respectively having average particle diameters of 0.006 μm (comparative example 7), 0.016 μm (example 2), 0.083 μm (example 3), 0.33 μm (example 4), 0.39 μm (example 5), and 0.64 μm (comparative example 8), composed of magnetite having the same composition as that used in the example 1, having the particle shape of an octahedron that is a convex polyhedron surrounded by eight triangles as a basis, whose vertexes and edges are each in a curved surface shape, and having a portion that can be taken as a straight line on the outer periphery of its projected image.

1.0 mass part of silica [RA-200H produced by NIPPON AEROSIL CO., LTD.] and 2.0 mass parts of titanium oxide [EC-100 produced by TITAN KOGYO KABUSHIKI KAISHA] were added to 100 mass parts of the magnetic toner in each of the examples and the comparative examples, and were mixed using a HENSCHEL mixer, to then evaluate each of the properties previously described in a case where image formation was actually performed using a complex machine having a magnetic one-component jumping developing system [KM-1650 manufactured by KYOCERA MITA CORPORATION, described above] equipped with an organic photoreceptor as a latent image holding member. Usable as the developer carrying member was one produced by SUS305 having a diameter of 20 ϕ and having a ten-point average surface roughness Rz of 4.0 μm.

The results, together with the results in the example 1, are shown in Tables 4 to 6:

TABLE 4

| | | Normal temperature and normal humidity test (temperature 20° C., relative humidity 65% RH) | | | | | | | |
|---|---|---|---|---|---|---|---|---|---|
| | Average particle | Charging amount (μC/g) | | Image density | | Fogging | | Layer non-uniformity | |
| | diameter (μm) | At beginning | After duration | At beginning | After duration | At beginning | After duration | At beginning | After duration |
| Comparative example 7 | 0.006 | 7.8 | 8.5 | 1.24 | 1.28 | Δ | ○ | ○ | ○ |
| Example 2 | 0.016 | 9.8 | 10.7 | 1.35 | 1.37 | ○ | ○ | ○ | ○ |
| Example 3 | 0.083 | 10.5 | 11.7 | 1.38 | 1.41 | ○ | ○ | ○ | ○ |
| Example 1 | 0.22 | 11.8 | 13.7 | 1.42 | 1.39 | ○ | ○ | ○ | ○ |
| Example 4 | 0.33 | 12.6 | 14.8 | 1.41 | 1.37 | ○ | ○ | ○ | ○ |
| Example 5 | 0.39 | 13.1 | 16.1 | 1.41 | 1.34 | ○ | ○ | ○ | ○ |
| Comparative example 8 | 0.64 | 14.5 | 30.5 | 1.38 | 1.14 | ○ | X | ○ | ○ |

TABLE 5

| | Average particle diameter (μm) | High-temperature and high-humidity test (temperature 33° C., relative humidity 85% RH) | | | | | | | |
|---|---|---|---|---|---|---|---|---|---|
| | | Charging amount (μC/g) | | Image density | | Fogging | | Layer non-uniformity | |
| | | At beginning | After duration | At beginning | After duration | At beginning | After duration | At beginning | After duration |
| Comparative example 7 | 0.006 | 6.4 | 6.8 | 1.19 | 1.25 | Δ | X | ○ | ○ |
| Example 2 | 0.016 | 8.5 | 9.3 | 1.33 | 1.37 | ○ | ○ | ○ | ○ |
| Example 3 | 0.083 | 9.2 | 10.8 | 1.35 | 1.38 | ○ | ○ | ○ | ○ |
| Example 1 | 0.22 | 10.5 | 11.6 | 1.39 | 1.40 | ○ | ○ | ○ | ○ |
| Example 4 | 0.33 | 11.2 | 12.9 | 1.43 | 1.40 | ○ | ○ | ○ | ○ |
| Example 5 | 0.39 | 12.6 | 15.1 | 1.42 | 1.38 | ○ | ○ | ○ | ○ |
| Comparative example 8 | 0.64 | 13.4 | 25.2 | 1.39 | 1.14 | ○ | X | ○ | ○ |

TABLE 6

| | Average particle diameter (μm) | Low-temperature and low-humidity test (temperature 10° C., relative humidity 20% RH) | | | | | | | |
|---|---|---|---|---|---|---|---|---|---|
| | | Charging amount (μC/g) | | Image density | | Fogging | | Layer non-uniformity | |
| | | At beginning | After duration | At beginning | After duration | At beginning | After duration | At beginning | After duration |
| Comparative example 7 | 0.006 | 8.8 | 9.7 | 1.26 | 1.33 | Δ | ○ | ○ | ○ |
| Example 2 | 0.016 | 10.2 | 11.3 | 1.36 | 1.37 | ○ | ○ | ○ | ○ |
| Example 3 | 0.083 | 11.5 | 13.4 | 1.38 | 1.41 | ○ | ○ | ○ | ○ |
| Example 1 | 0.22 | 12.7 | 14.9 | 1.42 | 1.37 | ○ | ○ | ○ | ○ |
| Example 4 | 0.33 | 13.7 | 16.1 | 1.41 | 1.35 | ○ | ○ | ○ | ○ |
| Example 5 | 0.39 | 14.2 | 17.1 | 1.41 | 1.33 | ○ | ○ | ○ | ○ |
| Comparative example 8 | 0.64 | 16.2 | 35.3 | 1.38 | 1.14 | ○ | X | ○ | ○ |

It was confirmed from Tables that in magnetic toner in the comparative example 7 using the magnetic powder having the shape of an octahedron, whose vertexes and edges are each in a curved surface shape, and having a portion that can be taken as a straight line on the outer periphery of its projected image, while having an average particle diameter of less than 0.01 μm, the initial image density was below 1.30 in each of the tests under the environments, the image density after duration was below 1.30 in the normal temperature and normal humidity test and high-temperature and the high-humidity test. Further, fogging was produced in the high-temperature and high-humidity test. When the cause was examined, it was determined that the ratio at which the magnetic powder was exposed to the surfaces of the toner particles was increased, and charges were discharged from the exposed magnetic powder, causing deficiency in charging of the magnetic toner.

It was confirmed that in magnetic toner in the comparative example 8 using the magnetic powder having the shape of an octahedron, whose vertexes and edges are each in a curved surface shape, having a portion that can be taken as a straight line on the outer periphery of its projected image, while having an average particle diameter in excess of 0.50 μm, the charging amount after duration rose, the image density was lowered, and fogging was produced in each of the tests under the environments, so that charge-up occurred. When the cause was examined, it was determined that the ratio at which the magnetic powder was exposed to the surfaces of the toner particles was decreased, and charges discharged from the exposed magnetic powder were reduced.

On the other hand, it was confirmed that in the magnetic toner in each of the examples 1 to 5 using the magnetic powder having the shape of an octahedron, whose vertexes and edges are each in a curved surface shape, having a portion that can be taken as a straight line on the outer periphery of its projected image, and having an average particle diameter of 0.01 to 0.50 μm, it was possible to keep respective charging amounts and image densities at the beginning and after duration approximately constant as well as to form a good image by preventing fogging from being produced in all the normal temperature and normal humidity test, the low-temperature and low-humidity test, and the high-temperature and high-humidity test.

When the examples were compared, the smaller the average particle diameter of the magnetic powder was, the smaller the initial charging amount tended to be. Conversely, the larger the average particle diameter was, the larger the charging amount after duration tended to be particularly in the low-temperature and low-humidity test. From the results, it was confirmed that the average particle diameter of the magnetic powder was preferably 0.05 to 0.35 μm and more preferably 0.15 to 0.30.

This application corresponds to Japanese Patent Application No. 2004-296902 filed with the Japanese Patent Office on Oct. 8, 2004, the disclosure of which is incorporated herein by reference.

What is claimed is:

1. The Magnetic toner for magnetic one-component jumping developing methods, said toner comprising:

toner particles formed of binder resin including magnetic powder having an average particle diameter of 0.01 to 0.5 μm, and having a particle shape of an octahedron that is a convex polyhedron surrounded by eight triangles as a basis, each of the vertexes and edges of the octahedron being in a curved surface shape, and having a portion that can be taken as a straight line on the outer periphery of its projected image, wherein the magnetic powder is formed of magnetite containing at least one element selected from the group consisting of Mn, Zn, Ni, Cu, Al, Ti, and Si that is 0.1 to 10 atom % of Fe.

2. The magnetic toner for magnetic one-component jumping developing methods according to claim 1, wherein the average particle diameter of the magnetic powder is 0.05 to 0.35 μm.

3. The magnetic toner for magnetic one-component jumping developing methods according to claim 1, wherein the content of the magnetic powder is 35 to 65 mass %.

* * * * *